United States Patent [19]

Hilfiker

[11] Patent Number: 4,993,879

[45] Date of Patent: Feb. 19, 1991

[54] CONNECTOR FOR SECURING SOIL REINFORCING ELEMENTS TO RETAINING WALL PANELS

[76] Inventor: William K. Hilfiker, 5135 Blackberry, Eureka, Calif. 95501

[21] Appl. No.: 488,277

[22] Filed: Mar. 2, 1990

Related U.S. Application Data

[63] Continuation-in-part of Ser. No. 320,630, Mar. 8, 1989.

[51] Int. Cl.[5] ..... E02D 29/02

[52] U.S. Cl. ..... 405/262; 405/286; 405/258; 403/207; 403/209

[58] Field of Search ..... 405/262, 266, 267, 258, 405/259, 270, 274, 275, 284, 285, 286, 287; 403/209, 210, 211, 212, 213, 161, 207, 208

[56] References Cited

U.S. PATENT DOCUMENTS

| | | | |
|---|---|---|---|
| 706,193 | 8/1902 | McCay | 403/207 X |
| 788,954 | 5/1905 | Shellaberger | 403/207 X |
| 818,710 | 4/1906 | Roberts | 403/207 |
| 1,771,131 | 7/1930 | Manners | 403/209 X |
| 2,045,112 | 6/1936 | Upson | 405/262 |
| 2,223,109 | 11/1940 | Keihl, Jr. | 403/210 X |
| 3,111,060 | 11/1963 | Peeling | 87/13 |
| 3,316,721 | 5/1967 | Heilig | 405/262 |
| 4,125,970 | 11/1978 | Vidal | 52/31 |
| 4,154,554 | 5/1979 | Hilfiker | 405/273 |
| 4,324,508 | 4/1982 | Hilfiker et al. | 405/284 |
| 4,329,089 | 5/1982 | Hilfiker et al. | 405/262 |
| 4,341,491 | 7/1982 | Neumann | 405/262 X |
| 4,470,728 | 9/1984 | Broadbent | 405/284 |
| 4,505,621 | 3/1985 | Hilfiker et al. | 405/258 X |
| 4,514,113 | 4/1985 | Neuman | 405/286 |
| 4,624,155 | 11/1986 | Wing | 403/213 X |
| 4,725,170 | 2/1988 | Davis | 405/286 |
| 4,728,227 | 3/1988 | Wilson | 405/284 |
| 4,834,584 | 5/1989 | Hilfiker | 405/262 |
| 4,856,939 | 8/1989 | Hilfiker | 405/258 X |
| 4,929,125 | 5/1990 | Hilfiker | 405/262 |
| 4,952,098 | 8/1990 | Grayson et al. | 405/262 |

*Primary Examiner*—Dennis L. Taylor
*Assistant Examiner*—J. Russell McBee
*Attorney, Agent, or Firm*—Limbach, Limbach & Sutton

[57] ABSTRACT

Connectors are provided for securing soil reinforcing elements to the face panels of a retaining wall for an earthen formation. The connectors comprise rigid eyes fixed to the panels and extensions formed on the elements for extension through the eyes. The eyes and extensions are selectively locked together and serve to orient the reinforcing elements in a horizontal disposition within the soil embankment being reinforced.

15 Claims, 4 Drawing Sheets

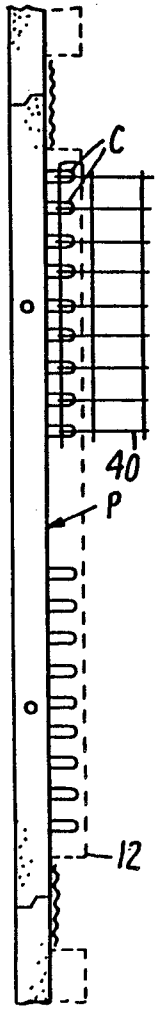
FIG. 7.
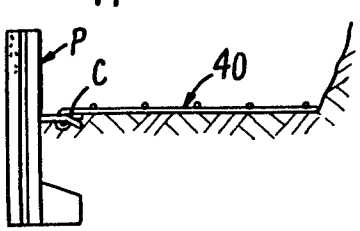
FIG. 6A.
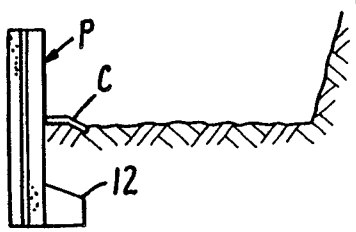
FIG. 6B.
FIG. 6C.
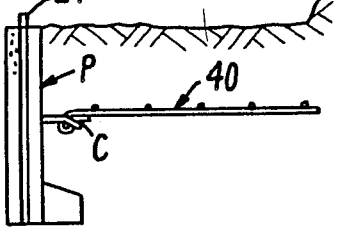
FIG. 6D.
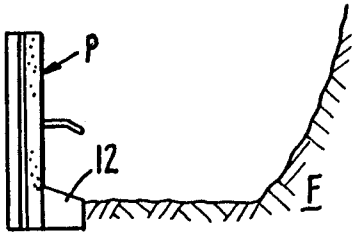
FIG. 6E.
FIG. 6F.
FIG. 6G.
FIG. 6H.

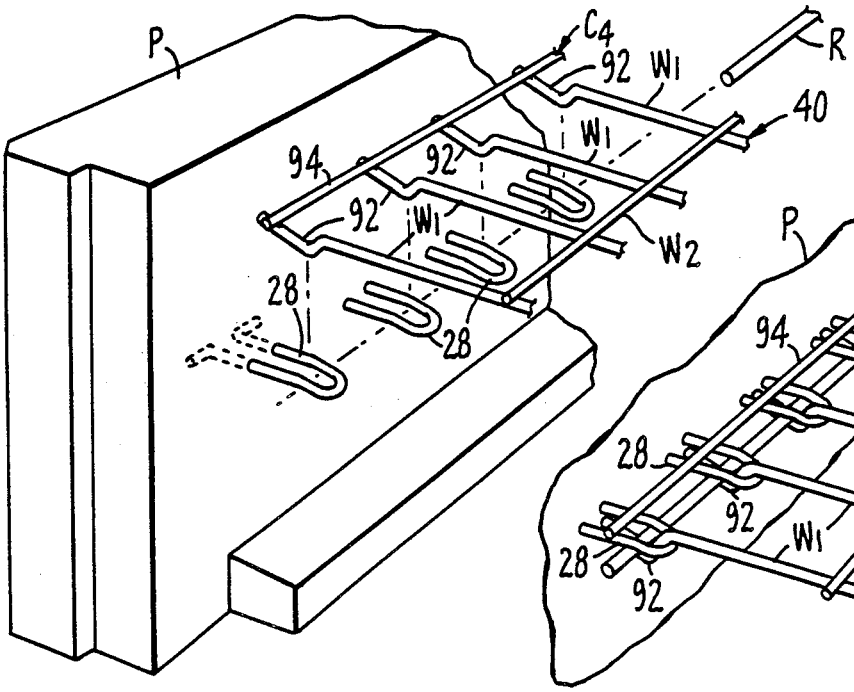
FIG. 13.
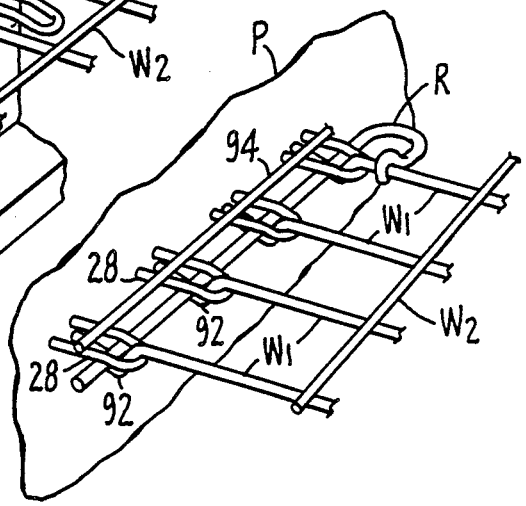
FIG. 14.
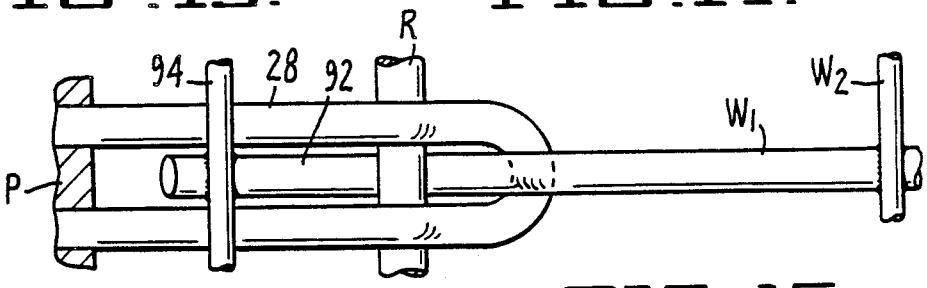
FIG. 15.
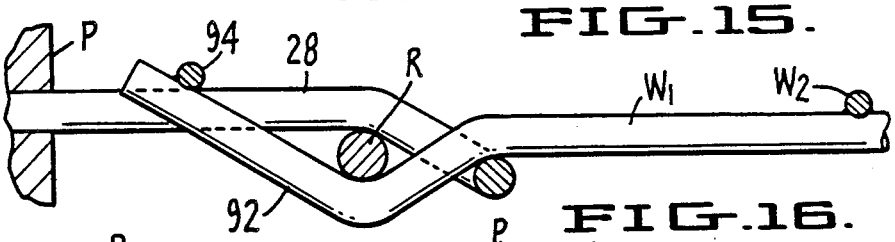
FIG. 16.
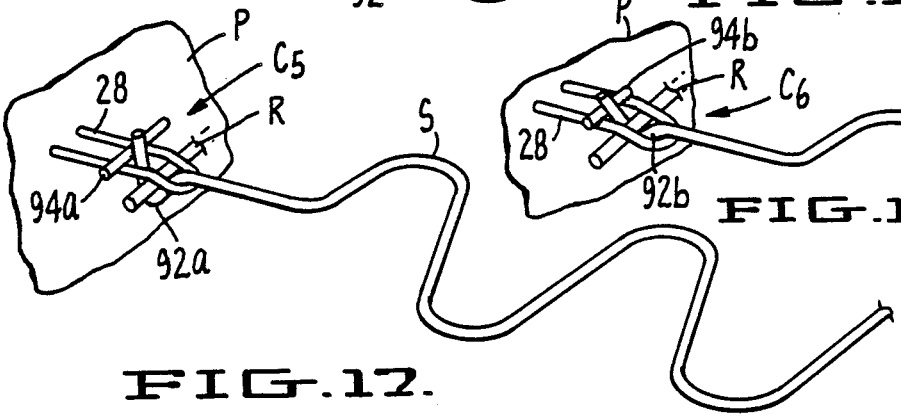
FIG. 18.
FIG. 17.

CONNECTOR FOR SECURING SOIL REINFORCING ELEMENTS TO RETAINING WALL PANELS

RELATED APPLICATION

This application is a continuation-in-part of Pat. application Ser. No. 320,630, filed Mar. 8, 1989.

BACKGROUND OF THE INVENTION

The present invention relates to a reinforced soil retaining wall for earthen formations and, more particularly, is directed to such a wall having concrete face panels and attached soil reinforcing elements. In its more specific aspects, the invention is concerned with an improved connector for securing soil reinforcing elements to the face panels.

In the prior art it is well known to provide retaining walls for earthen embankments with elongated reinforcing elements. The reinforcing elements may take any number of forms, such as: welded wire mats, polymer geogrids, metal straps, or rods provided with lateral extensions. Although such walls make the earthen formation essentially self-sustaining, they are also often provided with face panels which serve both a decorative architectural function and to prevent erosion at the face of the embankment. The panels are generally secured to at least certain of the reinforcing elements. The most common means of securing has taken the form of loops formed on the elements which are in some way fastened to the panels, as for example by means of pins or bolts. Since the panels of such walls do not carry a significant load, they are generally relatively thin and simply stacked upon one another. In some cases, they have been provided with enlarged bases which serve to assist in stacking and to maintain the panels in an upright condition.

SUMMARY OF THE INVENTION

The connector of the present invention comprises mutually engagable connecting elements on the panels and the elements. The connecting elements on the panels comprise horizontally disposed anchor eyes fixed to and extending laterally from the panels. The connectors on the soil reinforcing elements comprise extensions on the elements extensible through the eyes. Once extended through the eyes, the extensions are secured from the eyes by selectively operable securing means associated with the extensions.

A principal object of the invention is to provide an improved connector for securing soil reinforcing elements to face panels wherein connection is provided by extensions on the elements which are received within eyes extending from the panels.

Still another object related to the latter object is to provide such a connector which serves to orient the soil reinforcing elements in a horizontal disposition.

These and other objects will become more apparent when viewed in light of the following detailed description and accompanying drawings.

BRIEF DESCRIPTION OF THE DRAWINGS

FIGS. 6A through 6H are cross-sectional side elevational views showing the steps of constructing a soil reinforced embankment through use of the first embodiment panels and connectors;

FIG. 7 is a cross-sectional view taken on the plane designated by line 7—7 of FIG. 6;

FIG. 13 is an exploded perspective view, with parts thereof broken away, showing a fourth embodiment connector for use in securing a soil reinforcing mat to a face panel;

FIG. 14 is a perspective view, with parts thereof broken away, illustrating the connector of FIG. 13 in place securing a soil reinforcing mat to a face panel;

FIG. 15 is a plan view, with parts thereof broken away, illustrating one of the connectors of FIG. 13 in place in securing a soil reinforcing mat to a face panel;

FIG. 16 is a side elevational view, with parts thereof broken away and shown in section, of the connector shown in FIG. 15;

FIG. 17 is a perspective view, with parts thereof broken away, illustrating a fifth embodiment connector connecting a swiggle-like soil reinforcement of the type shown in applicant's U.S. Pat. No. 4,834,584 to a face panel; and, FIG. 18 is a perspective view, with part thereof broken away, illustrating a sixth embodiment connector connecting a swiggle-like soil reinforcement of the type shown in applicant's U.S. Pat. No. 4,834,584 to a face panel.

DESCRIPTION OF THE PREFERRED EMBODIMENTS

Figure 1:
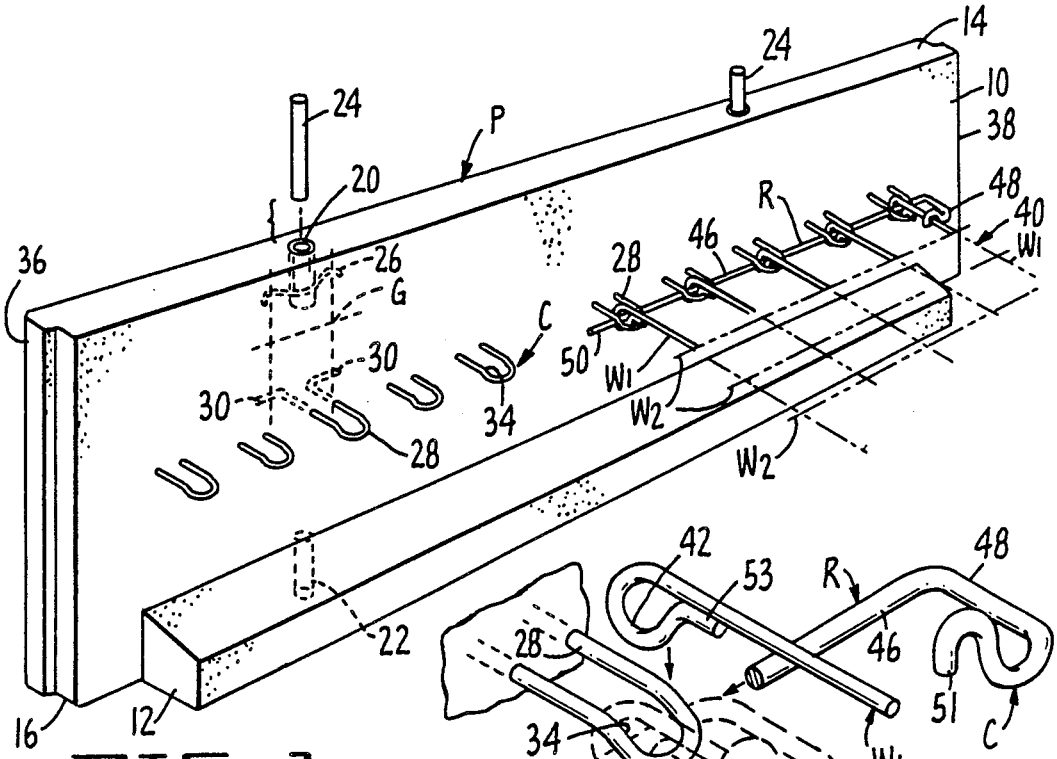
FIG. 1 is a perspective view of a first embodiment panel and the connectors therefor, with one alignment pin shown in exploded perspective.

Referring to FIG. 1, the first embodiment face panel is designated in its entirety by the letter "P". The panel is formed of reinforced concrete and comprises a planar body section 10 and an integrally formed cantilever section 12. The planar body section 10 has flat top and bottom edge surfaces 14 and 16, respectively. As will become more apparent from the subsequent discussion the top edge 14 is mutually engagable with the bottom edge of a like panel stacked thereabove. Cylindrical sockets 20 and 22, respectively, are formed in the surfaces 14 and 16 for the receipt of alignment pins 24. The sockets 20 and 22 are vertically aligned and, when the panels are stacked, the pins are received in the sockets to maintain the stacked panels in alignment. As shown in phantom in FIG. 1, the panel "P" is reinforced by an internal gridwork "G" of reinforcing steel. During casing of the panel, the sockets 20 and 22 are formed by plastic sleeves secured to the gridwork by wire hangers 26.

The panel "P" also includes first embodiment connectors "C" cast in place within the face section 10. The connectors are disposed in horizontal alignment and each comprise a generally U-shaped wire segment 28 having legs which extend into the face panel and lateral extensions 30 which extend to the front side of the gridwork (as viewed in FIG. 1). To minimize the likelihood of galvanic corrosion within the concrete of the panel, the wire segments 28 preferably are spaced from the gridwork "G". The wire segment 28, together with the inner surface of the panel 10, defines an eye 34 having a distal end segment 35. The distal end segment 35 extends downwardly at approximately 25° to 30° from horizontal.

The ends of the panel "P" are designated by the numerals 36 and 38. In the preferred embodiment illustrated, these ends are of a tongue and groove configuration so that when arranged in horizontally aligned tiers the ends of adjacent panels will mate. From FIG. 1, it will be seen that the ends of the cantilever section 12 are spaced inwardly from the panel ends 36 and 38. This spacing is provided so that a filter fabric may be extended over the mating ends of the panels to the inside of the body sections 10.

In a typical embodiment, the panel "P" would have the following proportions:

| | |
|---|---|
| Length: | 12½ feet |
| Height: | 2½ feet |
| Thickness of body section 10: | 5 inches |
| Depth of cantilever section (measured from back of body section): | 6 inches |
| Distance between ends of body section 10 and ends of cantilever section 12: | 8 inches |
| Distance between bottom of section 10 and level of connectors "C": | 15 inches |

From this example, it will be seen that the ratio of the distance between the bottom of the panel and the level of the connectors "C", to the depth of the cantilever section 12, is 15:6. This ratio is chosen so that the cantilever section will hold the panel against tilting during the backfilling operation until such time as soil reinforcements are secured to the connectors "C" and anchored within the backfill.

The soil reinforcing elements depicted in FIG. 1 take the form of welded wire gridworks 40. Each gridwork comprises spaced generally parallel longitudinally extending wires "$W_1$" and spaced generally parallel transversely extending wires "$W_2$". The wires "$W_1$" and "$W_2$" are welded together at their intersections. The ends of the wires "$W_1$" adjacent the panel "P" are formed with extensions in the form of vertically disposed loops 42 extending downwardly from and generally normal to the body of the wire "$W_1$", and proportioned for receipt in the eyes 34 of the connectors "C".

From FIG. 1, it will be appreciated that the connectors "C" are spaced and positioned so as to align with the longitudinal wires "$W_1$" of the gridworks 40. In use, a gridwork is secured to a panel by extending the loops 42 thereof through the connectors "C" of the panel (see FIG. 2) to pass the loops through the eyes 34 from one side of the connectors to the other (see FIG. 3). A retaining rod "R" is then extended through the loops 42 to the bottom side of the connectors "C" (see FIG. 4), thus securing the gridwork against separation from the connectors. Due to the downward inclination of the distal end segments 35 of the eyes, tension applied to the wires "$W_1$" functions to draw the rod "R" against the segments.

The retaining rod "R" has an elongate body section 46 with an L-shaped handle 48 at one end and a smooth head 50 at the other end. The head 50 is proportioned to slide through the loops 42 to guide the rod into place. A hook section 51 is formed on the distal end of the handle 48. After the rod "R" is passed fully through the loops, the handle 48 is turned to engage the hook section over one of the wires "$W_1$", thus securing the rod against displacement from the loops.

From the above described description of the structure and mode of operation of the connector "C", it will be appreciated that the connectors provide for the securing of soil reinforcing elements to the panels with a minimum of modification of the structure of the elements. In the FIG. 1 embodiment, the modification involves forming the downwardly extending loops 42 on the wires "$W_1$", with the distal ends 53 of the wire forming the loops folded against the underside of the wires "$W_1$". No weld between the ends 53 and the wires "$W_1$" is required. When the wires "$W_1$" are subjected to tension, the ends 53 frictionally bind between the eyes 34 and the wires "$W_1$" to prevent the loops straightening out. This frictional binding is aided by the drawing of the rod "R" against the inclined segments 35 of eyes as the result of such tension.

Figure 4:
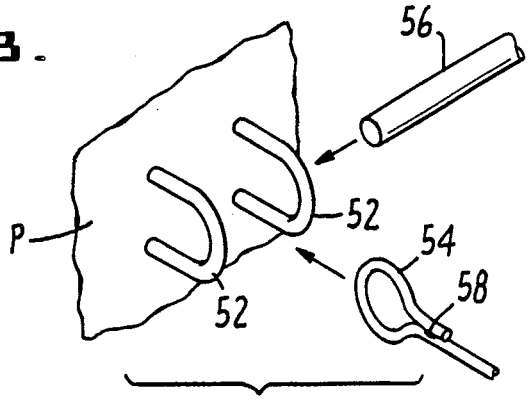
FIG. 4. (PRIOR ART)
FIG. 4 is an exploded perspective view showing a prior art connection.
Figure 5:
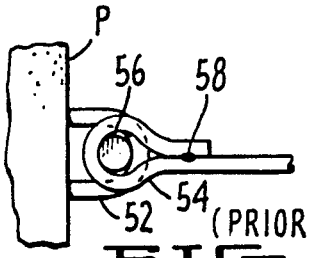
(PRIOR ART) FIG. 5
FIG. 5 is a side elevational view showing the prior art connector of FIG. 4 in condition securing an element to a panel.

FIGS. 4 and 5 show a prior art arrangement for securing soil reinforcements to panels. In this arrangement, each connection requires a pair of vertically disposed loops 52 secured to and extending from the panel and a closed loop 54 formed on the end of the soil reinforcing element In use, the loop 54 is first positioned between a pair of loops 52 and a rod 56 is then extended through the aligned loops to secure the loop 54 to the loops 52. A spot weld 58 secured the distal end of the loop to wire from which it extends to hold the loop against opening. The connection is dependent on the integrity of this weld.

FIG. 6 depicts the steps used to construct a reinforced soil embankment from panels and soil reinforcing gridworks of the type illustrated in FIG. 1. In step A a first tier of panels "P" is placed at the foot of the earthen formation "F" where the embankment is being constructed. Step B shows backfill soil placed behind the first tier of panels "P" and over the cantilever sections 12 thereof to the level of the connectors "C". Step C shows the welded wire soil reinforcing gridworks 40 secured to the connectors "C" and extended over the backfill soil. Step D shows the backfill continued to the level of the upper edge of the panels "P" and the alignment pins 24 placed in the sockets in the top edge surfaces of the first tier of panels. Step E shows a second tier of panels "P" stacked above the first tier with the bottom surfaces of the second tier panels resting on the top surfaces of the panels in the first tier and the alignment pins 24 engaged in the opposed sockets of the stacked panels. As shown in step E, wedges 60 have been inserted between the cantilever sections 12 of the second tier of panels and the backfill soil therebeneath to plumb the second tier of panels relative to the first tier. Step F shows backfill placed behind the second tier of panels and over the cantilever sections 12 thereof to the level of the connectors "C". Step G shows welded wire gridworks 40 secured to the connectors "C" of the second tier and placed over the backfill therebeneath. Step H shows backfill placed over the gridworks 40 extending from the second tier of panels and, in phantom, the placement of a third tier of panels over the second tier.

The embankment is erected to the desired height by placing successive tiers of panels and the reinforcing gridworks and backfill therefor through steps corresponding to steps E through H for each successive tier. The resulting embankment is comprised of soil reinforced by the gridworks 40, with panels "P" at the face thereof. The panels are held in place both by the cantilevered sections 12 and the gridworks 40. During erection of the embankment, the cantilever sections 12 of each tier of panels "P" serve to secure the panels in vertical orientation as backfill is placed and compacted to the level of the connectors "C" extending from the panels. Once the gridworks 40 are extended from the panels and backfill is placed thereover, the primary force retaining the panels in vertical orientation is provided by the gridworks.

Figure 8:
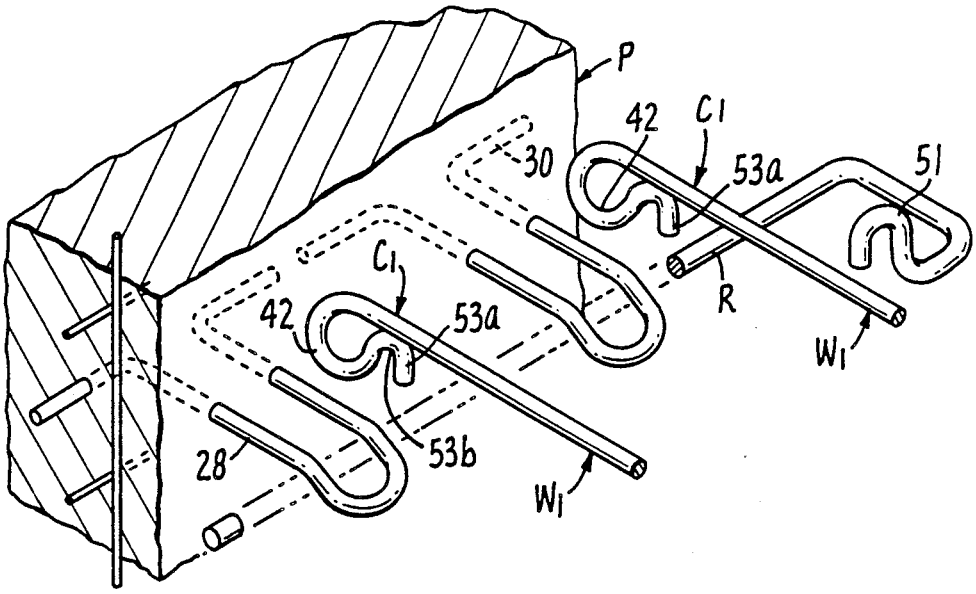
FIG. 8 is an exploded perspective view, with parts thereof broken away, showing a second embodiment of the connector for use in securing a soil reinforcing mat to a face panel.
Figure 9:
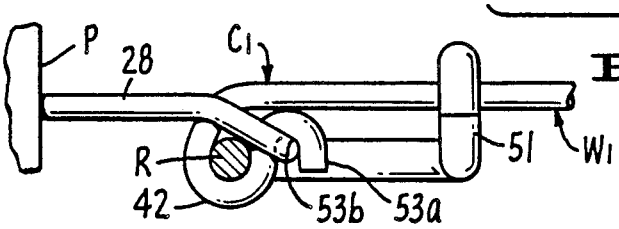
FIG. 9 is a side elevational view of the connector of FIG. 8, showing the mat secured in place.

FIGS. 8 and 9 show a second embodiment connector "$C_1$". This connector differs from that of FIGS. 1 to 3 only in that the distal end, designated 53*a*, of the wire "$W_1$", forming the loop 42 is bent downwardly to form a hook 53*b* proportioned for engagement over the wire segment forming the eye 34. The hook 53*b* functions to further secure the loop 42 against movement relative to the eye 34. Other than this difference, the connector "$C_1$" functions and is used in the same way as the "C". The retaining rod "R" functions in the FIGS. 8 and 9 embodiment in the same manner in which it functioned in the FIGS. 1 to 3 embodiment.

Figure 2:
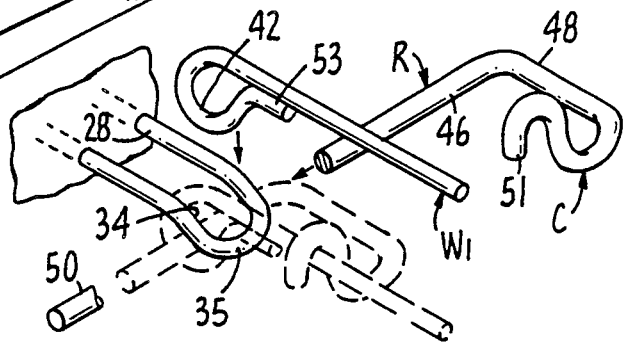
FIG. 2 is an exploded perspective view showing one of the connectors of the first embodiment panel in exploded condition.
Figure 3:
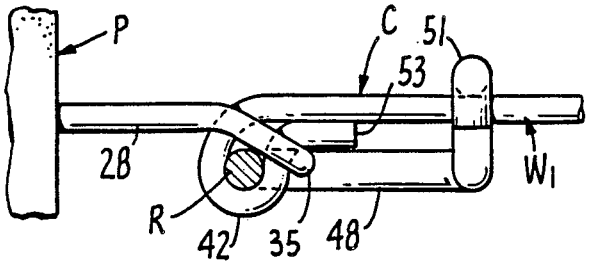
FIG. 3 is a side elevational view showing one of the connectors of the first embodiment panel in condition securing a reinforcing element to the panel.
Figure 10:
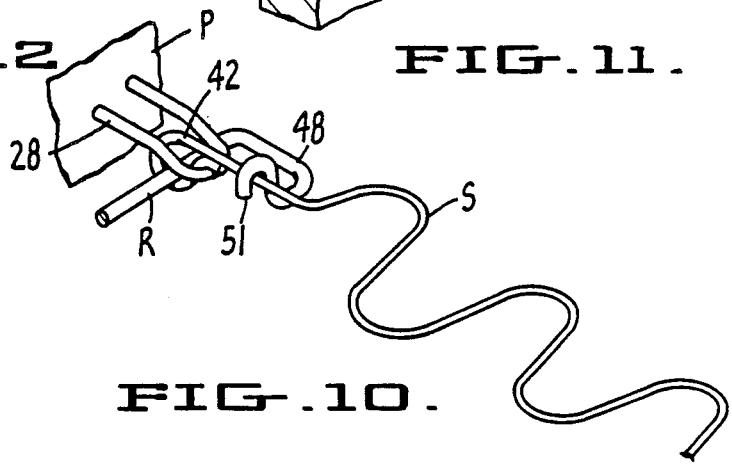
FIG. 10 is a perspective view showing how the connector of the first embodiment panel could be used to secure the panel to swiggle-like soil reinforcements of the type shown in applicant's U.S. Pat. No. 4,834,584, issued May 30, 1989.

FIG. 10 illustrates a connector "C" identical to the first embodiment connector of FIGS. 1 to 3 in use in securing a swiggle soil reinforcement "S" to a panel "P". From this figure, it will be seen that the connector "C" and the loop 42 formed on the end of the soil reinforcement "S" serve both to secure the reinforcement to the panel and to horizontally orientate the swiggles of the soil reinforcement.

Figure 12:
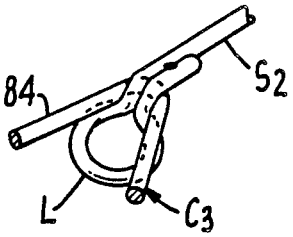
FIG. 12 is a perspective view of the looped end of the soil reinforcing wire of the FIG. 11 connector.
Figure 11:
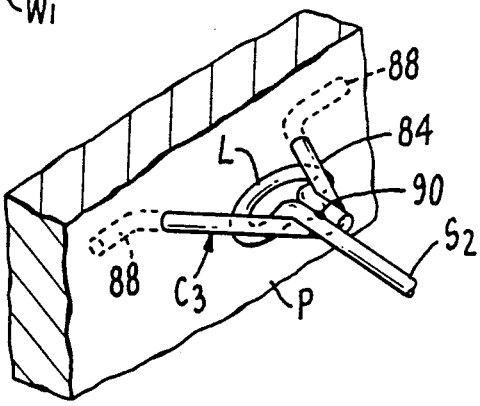
FIG. 11 is a perspective view, with parts thereof broken away, showing a third embodiment connector for use in securing a metallic soil reinforcing element to a face panel.

FIGS. 11 and 12 show a third embodiment connector for securing metallic soil reinforcing elements to the face panels "P". This connector designed "$C_3$" may be used for securing metallic soil reinforcing elements of either the gridwork type 40 or the swiggle type "S". The connector "$C_3$" takes the form of a wire 84 projecting horizontally from the panel "P" to define a V-shaped eye, with laterally extending legs 88 cast in place within the panel. The soil reinforcing element shown in FIG. 11 is designated "$S_2$" and is formed with a bent down loop "L" proportioned for extension through the V-shaped wire 84. When received within the V-shaped wire and subjected to pull back tension (tension to the right as viewed in FIG. 11), the loop "L" locks within the converging end of the V-shaped wire 84, thus securing the soil reinforcement "$S_2$" from separation from the panel "P".

The loop "L" is rigid with the reinforcement "$S_2$" and extends downwardly from the longitudinal axis of the reinforcement at an angle of approximately 60°. In the preferred embodiment, the loop "L" is formed by bending the distal portion of the soil reinforcement "$S_2$" into a loop, with a spot weld 90 securing the loop against spreading. The connector "$C_3$" has the advantage that it does not require a retaining rod, such as the rod "R" and that it also may serve to horizontally orient the soil reinforcement "$S_2$" within an earthen formation.

FIGS. 13 to 16 show a fourth embodiment connector "$C_4$" connecting welded wire gridwork mats 40 to a face panel "P". The panels "P", including the U-shaped wire segments 28 extending therefrom, correspond to those used with the first embodiment connectors "C". The mats 40 also correspond to those used with the first embodiment connector, as depicted in FIG. 1.

The connector "$C_4$" differs from that of the first embodiment in that extensions in the form of kinked V-shaped sections 92 are formed on the wires "$W_1$" in place of the loops 42 and a cross-rod 94 is fixed to and extends across the distal ends of the sections 92. As shown, the cross-rod 94 is welded to the tops of the portions of the wires "$W_1$" forming the sections 92.

In use, the V-shaped sections 92 of the fourth embodiment connector are extended through the eyes provided by the wire segments 28 as shown in FIG. 14. In the latter condition, the cross-rod 94 rests against the top of the wire segments 28 to limit the degree to which the V-shaped sections extend through the eyes provided by the wires 28. The connection is made secure by extending a retaining rod "R" through the V-shaped sections to the under side of the wire segments 28. The rod "R" is identical to that of the first embodiment connector and, when fully in place, is hooked over one of the wires "$W_1$" as seen in FIG. 14.

The fifth embodiment connector, designated "$C_5$", shown in FIG. 17 differs from the fourth embodiment primarily in that it is designed for use on a swiggle-type soil reinforcement "S" and that the connector extension on the swiggle has a sharper V-shaped section, designated 92*a*. Another difference is that the cross-rod 94*a* on the V-shaped section 92*a* is a short segment and welded to the outside of the V-shaped section. The panel "P" and eye forming wire segment 28 of the fifth embodiment correspond to those of the first embodiment connector "$C_1$".

The fifth embodiment connector "$C_5$" is used in a manner corresponding to that of the fourth embodiment connector "$C_4$". In this use, the V-shaped section 92*a* is extended through the eye provided by the wire segment 28 so that the cross-rod 94*a* rests across the legs of the segment 28 and the V-shaped segment 92*a* extends beneath the segment. The retaining rod "R" is then extended through the V-shaped section 92, as shown in FIG. 17. It should be appreciated that the connector "$C_5$" functions both to secure the swiggle "S" to the panel "P" and to position the swiggle "S" in a horizontal orientation.

The sixth embodiment connector shown in FIG. 18, designated "$C_6$", is essentially the same as the fifth embodiment connector, except for placement of the cross-rod, designated 94*b*. In the case of the sixth embodiment, the cross-rod 94*b* is welded to the top of the eye provided by the wire segments 28. The V-shaped section 92b of the connector "$C_6$" does not have a cross-rod welded thereto.

In use of the sixth embodiment, the V-shaped section 92b is extended through the eye provided by the wire segments 28 to the outside of the cross-rod 94b. As so positioned, the distal portion of the section 92b rests against the cross-rod 94b. The retaining rod "R" is then extended through the V-shaped section 92b to the under side of the wire segments 28. As so assembled, the connector "$C_6$" functions to secure the swiggle "S" to the panel "P" and maintain the swiggle in a horizontal orientation.

CONCLUSION

While preferred embodiments have been illustrated and described, it should be understood that the invention is not intended to be limited to the specifics of these embodiments, but rather is defined by the accompanying claims.

I claim:

1. An improved connector for securing a wire soil reinforcing element to the face panel of retaining wall for an earthen formation, said connector comprising:

(a) a rigid member fixed to and extending from the panel, said member defining a generally horizontally disposed eye;

(b) a generally V-shaped vertically disposed extension formed on said wire reinforcing element and proportioned for extension through said eye from one side of the member to the other; and, (c) a rod extensible through the V-shaped extension to said other side of the member and engageable with the member when so disposed to secure the extension against removal from the eye.

2. An improved connector according to claim 1 wherein the member is U-shaped and has spaced legs fixed to and extending from the panel and a closed end connecting said legs, said end being in spaced relationship to the panel.

3. An improved connector according to claim 2 further comprising a cross-element fixed to and extending across the legs of the member in spaced relationship to the closed end thereof and wherein the extension is proportioned to extend between said cross-element and closed end and includes a segment engageable with said cross-element to limit movement of the extension relative to the member.

4. An improved connector according to claim 1 wherein the extension includes a cross-element fixed thereto and engageable with the member when the extension is extended through the eye to limit movement of the extension relative to the member.

5. An improved connector for securing a wire soil reinforcing element for horizontal disposition within an earthen formation, said connector comprising:

(a) a rigid member defining an eye;

(b) a generally inflexible kinked extension formed on said wire reinforcing element and proportioned for extension through said eye from one side of the member to the other; and, (c) a rod extensible through the extension to said other side of the member and engageable with the member when so disposed to secure the extension against removal from the eye.

6. An improved connector according to claim 5, wherein:

(a) the member further comprises at least one cross-element extending across the eye; and, (b) the extension is proportioned to extend between said cross-element and one side of the eye and includes a segment engageable with the cross-element to limit movement of the extension relative to the member.

7. An improved connector according to claim 5 wherein the extension includes a cross-element engageable with the member when the extension is extended through the eye to limit movement of the extension relative to the member.

8. An improved connector for securing a wire soil reinforcing element for horizontal disposition within an earthen formation, said connector comprising:

(a) a rigid member defining an eye;

(b) a generally inflexible extension formed on said wire reinforcing element and proportioned for extension through said eye from one side of the member to the other; and, (c) means operatively associated with the extension and selectively engagable with said other side of the member to secure the extension against removal from the eye.

9. An improved connector for securing a wire soil reinforcing element for horizontal disposition within an earthen formation, said connector comprising:

(a) a rigid member defining a generally horizontally disposed eye;

(b) a generally circular vertically disposed loop formed on said wire reinforcing element and proportioned for extension through said eye from one side of the member to the other; and, (c) a rod extensible through the loop to said other side of the member and engagable with the member when so disposed to secure the loop against removal from the eye.

10. An improved connector according to claim 9, wherein:

(a) the wire reinforcing element has a distal end portion; and, (b) the loop is formed by bending said distal end portion downwardly and then back beneath the wire reinforcement element.

11. An improved connector according to claim 10 wherein, upon extension of the loop through the eye, at least a part of said distal end portion is captured between the eye and the wire reinforcing element.

12. An improved connector according to claim 11 wherein the part of said distal end portion is hook-shaped for engagement around the eye to limit movement of the loop relative to the eye when the loop is extended through the eye.

13. An improved connector according to claim 11 wherein the eye includes a downwardly inclined end segment and wherein tension applied to the wire soil reinforcing element functions to draw the rod against said segment when the loop is secured against removal from the eye by the rod.

14. An improved connector for securing a wire soil reinforcing element to a face panel and horizontally orienting the element within an earthen formation, said connector comprising:

(a) a rigid V-shaped wire fixed to and extending laterally from the panel in a generally horizontal disposition, said wire having side portions defining an eye therebetween and converging to an apex spaced from the panel; and (b) a rigid loop formed on a distal portion of the soil reinforcing element and extending downwardly from the element, said loop being proportioned for extension through the V-shaped wire and to be locked against separation therefrom by being captured within the apex of the wire upon pulling of the soil reinforcing element away from the panel.

15. An improved connector according to claim 13 wherein the soil reinforcing element comprises a wire and the loop is formed by a distal portion of the wire which is bent upon itself and spot welded together.

* * * * *